United States Patent [19]

Reid

[11] 4,208,038

[45] Jun. 17, 1980

[54] SIMPLIFIED ASSEMBLY OF RAIL FENCE

[76] Inventor: James E. Reid, 5440 E. Dahlia, Scottsdale, Ariz. 85254

[21] Appl. No.: 5,208

[22] Filed: Jan. 22, 1979

[51] Int. Cl.[2] ..... E04H 17/00

[52] U.S. Cl. ..... 256/65; 256/21

[58] Field of Search ..... 256/65, 67, 68, 69, 256/32, 47, 21, 59, 24, 25

[56] References Cited

U.S. PATENT DOCUMENTS

| | | | |
|---|---|---|---|
| 895,297 | 8/1908 | Peter | 256/65 |
| 2,690,326 | 9/1954 | Kranick | 256/21 |
| 3,092,407 | 6/1963 | Blonder | 256/65 UX |
| 3,157,388 | 11/1964 | Nelson | 256/68 |
| 3,410,527 | 11/1968 | Uroshevich | 256/65 X |
| 3,524,627 | 8/1970 | Boyanton et al. | 256/65 |
| 3,674,243 | 7/1972 | Brown | 256/35 X |

FOREIGN PATENT DOCUMENTS

| | | | |
|---|---|---|---|
| 260368 | 10/1964 | Australia | 256/69 |
| 106014 | 12/1966 | Denmark | 256/65 |

*Primary Examiner*—Andrew V. Kundrat

*Attorney, Agent, or Firm*—William H. Drummond

[57] ABSTRACT

Rail fence construction utilizes slide-fit sleeves fastened to fence post to slidably accept and support fence rails. Slide-fit end caps may be joined at selected angular dispositions to each other so as to permit the fence run to follow the contours of the land and to establish a fenced enclosure of the desired. Little or no cutting of rail lengths is required and the rail fence may be readily disassembled.

1 Claim, 7 Drawing Figures

SIMPLIFIED ASSEMBLY OF RAIL FENCE

This invention relates to apparatus and techniques for construction of post and rail fences.

In one respect, this invention relates to apparatus and techniques permitting a person to easily erect and dismantle a rail fence enclosure or corral.

In an important way, the invention relates to means for simplifying the assembly of fence rails to fence posts whereby much of the cutting of fence rail lengths is eliminated.

In another important and more specific detail, the invention relates to apparatus and techniques which permit even one not formerly skilled in the art to easily erect a rail fence which is readily comformable to ground contours and to the desired line of the fence run.

Rail fence construction is well known in the prior art, however a modicum of skill is generally required to erect such fences, particularly when the fence run traverses irregular or rolling ground contours, or the fence run itself is unusual as when enclosing an irregularly shaped area, say, for example, a hexagonal corral enclosure. Most prior attempts at simplifying rail fence construction require precise cutting of rail lengths to fit between the fence posts. Many employ welding or threaded rail ends for securing the rails to the posts. Most are limited to straight line runs or at least to rigid non-adjustable runs. None provide the facility for ease of disassembly.

Examples of prior art teachings which suffer such drawbacks may be found in the U.S. patents of Williams, U.S. Pat. No. 1,864,159; Ewing, U.S. Pat. No. 2,101,707; Blonder, U.S. Pat. No. 3,092,407; Moore, U.S. Pat. No. 3,604,687; and Carborne, U.S. Pat. No. 4,078,772.

It is therefore an object of the present invention to provide means for permitting one skilled only in the use of simple hand tools to easily erect, and later readily dismantle, a rail fence.

It is a further object of the invention to provide rail fences having straight runs as well as runs which follow land contours.

It is another object of the invention to permit the establishment of fence rails at various angles to each other so as to form a square, a rectangular, a hexagonal or other desired shape enclosure.

It is a specific objective of the invention that rail fences may be assembled(a) with little or no cutting of rail lengths, (b) without locking rails in position and thus permitting ease of disassembly, and (c) so that the angular disposition one rail may assume with respect to another is readily, simply, and easily established.

To accomplish these ends the rails are positioned on the posts by sliding said rails through sleeves affixed to the posts. The ends of the rails are terminated with a slide cap. Adjacent slide caps may be fastened together by nut and bolt or other simple fastener. The rails may be joined, using said slide caps, so as to form straight runs as well as runs which follow land contours, so too, said slide caps permit the rails to be joined to establish various angles to each other so as to form a desired shape enclosure. Because everything is slide fit, little or no cutting of rail lengths is required and the enclosure may be readily disassembled.

The invention will best be understood by reference to the detailed description which follows and to the accompanying illustrations of which:

Figure 3:
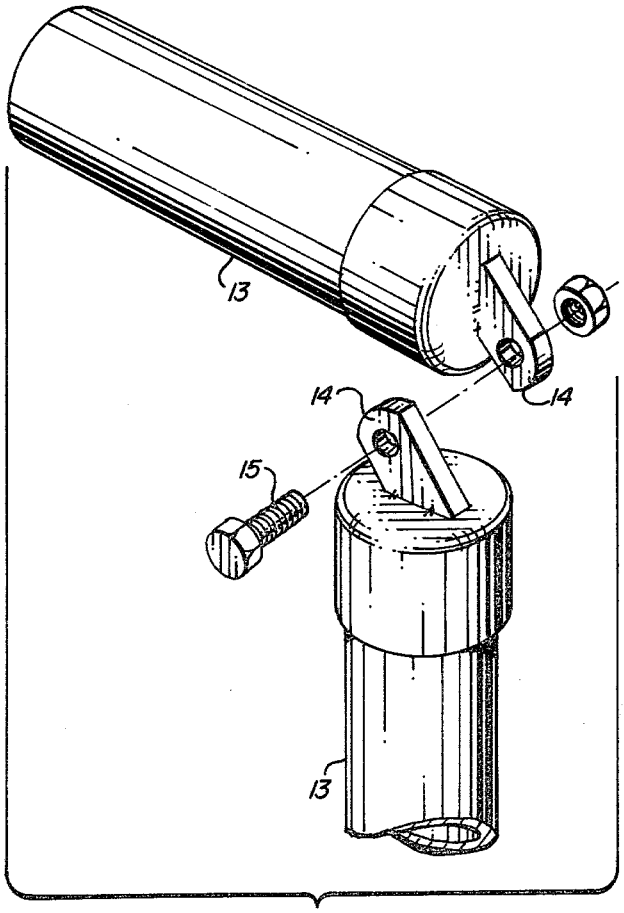

FIG. 3 details the end cap assembly.

Figure 4:
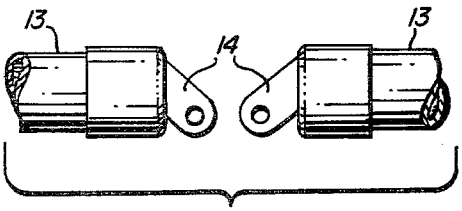
Figure 5:
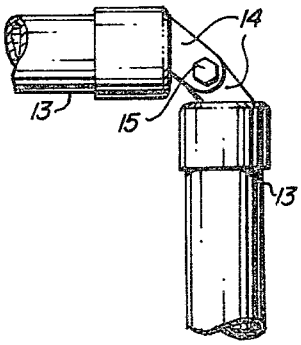

FIGS. 4 and 5 show the manner in which the end caps may be joined at various angles.

Figure 6:
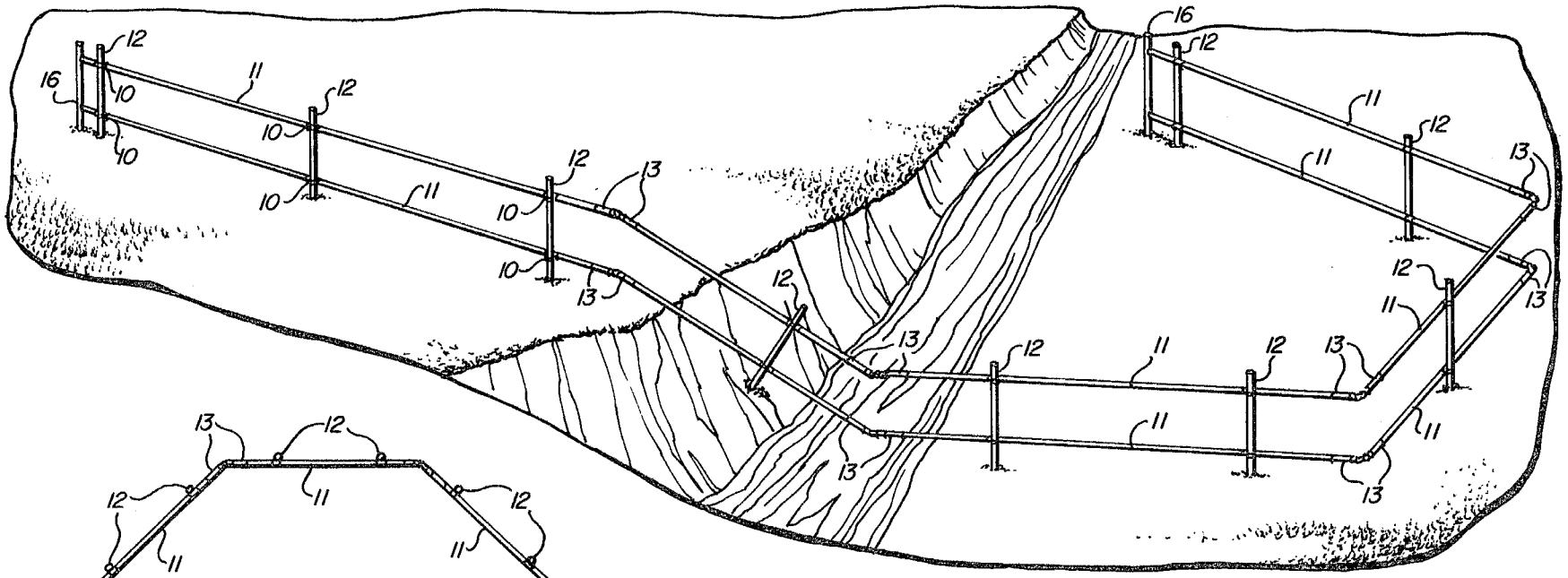

FIG. 6 illustrates the manner in which the fence run conforms to land contours.

Figure 7:
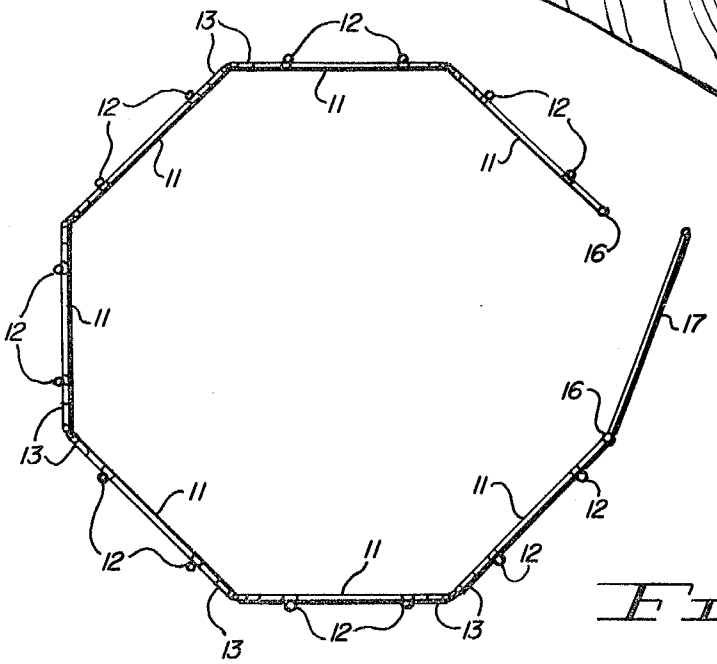

FIG. 7 illustrates the manner in which the end caps permit joining the rails so as to conform to the shape of the desired enclosure.

Although those having skill in the art will appreciate the ease with which the invention may be practiced, the invention may be best appreciated by those having little experience in fence construction and who possess only simple hand tools to accomplish their task. The novice, faced with an unusual shaped enclosure or difficult land contours, may find it expedient to assemble a run of fence rails along the ground, using the slide-fit end caps in the process. In this way, adjustments may be made in the run of the fence line, and the post positions staked out without the need for precision measuring or land surveying equipment.

Figure 1:
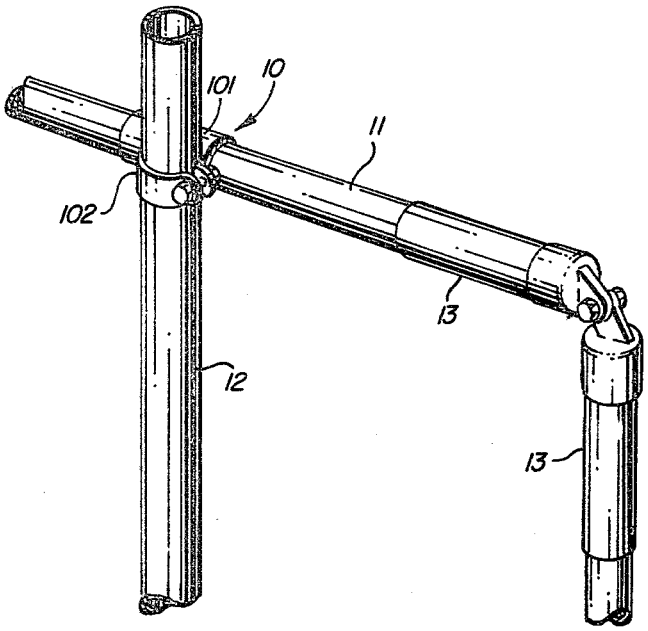
FIG. 1 is a view illustrating the assembly of the components parts of the rail fence.

As seen in FIG. 1, clamp/sleeve assembly 10 is provided for joining the fence rails to the fence posts. Sleeve 101 readily accepts fence rail 11. Sleeve 101 is designed so that fence rail 11 will pass through the sleeve with a slide fit. Clamp 102 of assembly 10 slidably accepts fence post 12. Simple fastening means are provided to secure clamp 102 firmly to post 12 after the clamp position has been adjusted as desired. With assembly 10 in place, post 12 provides the necessary support for fence rail 11 when rail 11 is passed slidably through sleeve 101.

In order to join the fence rails together into a continuous run, slide-fit end caps 13 are provided. Lug 14 at the end of each end cap 13 permits the end caps to be joined in a manner which allows them to swivel about the fastener employed to join lugs 14 in each end cap 13 together. The fastener which joins lugs 14 of adjacent end caps 13 may be a conventional screw fastener or something as homely and simple as a twisted wire fastener. When adjacent fence rails 11 are assembled, each with an end cap in place, and the lugs of these adjacent end caps fastened together, a continuous fence run results. See detail at FIG. 3.

It is readily seen that advantages may be derived from the ability to join the slip-fit end caps together such that they may pivot about the fastener used to join the end cap lugs together. FIG. 4 illustrates that adjacent end caps may be brought together in a manner which will permit lugs 14 to be fastened such that the axis of slip-fit sleeves 13 will lie in a straight line. Once fastened together, say be a simple nut and bolt assembly 15, the end caps 13 may be swiveled so as to form various angles with respect to each other. FIG. 5 shows two end caps 13 disposed at right angles to each other. As may be seen, a range of angular adjustment of 180° or better is readily available.

The illustrations of FIGS. 1 through 5 imply that the fence will be constructed using round pipe for fence posts and fence rails. This form is suggested because piping is readily available in various sizes suitable for the erection of fences and because the cost of such materials is relatively inexpensive when utilized in the manner taught herein. The use of the round cross-section which a pipe railing provides has an additional advantage. Because the end caps 13 are sized so as to slide easily over pipe rail 11, this means that the end cap may be rotated about the end of rail 11. If one considers that two adjacent end caps, when joined so that they may swivel with respect to each other, may also be rotated freely about the fence rails to which they are attached, one can readily see that the angular disposition of one fence rail with respect to the next is virtually infinitely variable. Thus, with end caps which may both swivel and rotate, the fence line may readily conform to the desired shape of the enclosure and to ground contours as well. It should be noted here however that the invention is not limited to use with railings and posts having circular cross-sections. Clamps, sleeves, and slide-fit end caps may be readily fabricated to any desired cross-section and employed in accordance with the teachings herein. In situations in which the fence and rail materials have other than circular cross-sections, the ability to join two rails at an infinite angular disposition may be readily regained, where necessary, through the use of two circular cross-section end caps joined by a short section of round railing. This rotatable circular cross-section assembly may be utilized in joining two non-rotatable end caps. Since the use of circular cross-section railing and posts avoids the necessity of such additional devices, the pipe rail fence illustrated is considered a preferred, but non-limiting, embodiment of the invention.

Figure 2:
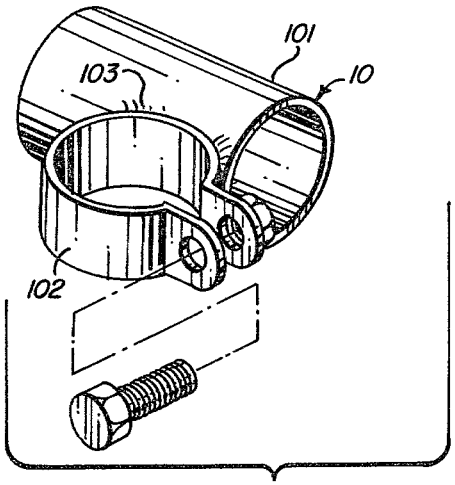
FIG. 2 is a detailed sketch of the clamp and sleeve assembly.

Clamp/sleeve assembly 10 is illustrated in greater detail in FIG. 2. Sleeve 101 has the cross-sectional shape which will readily admit fence rail 11. So too, clamp 102 is shaped so as to readily accept the shape employed for fence post 12. A simple fastener such as nut and bolt may be utilized to secure clamp 102 to fence post 12. Sleeve 101 and clamp 102 may be joined at 103 in any convenient, practical manner. The most commercially expedient fastening would be to join sleeve and clamp together at 103 by means of welding. An alternate, more costly means of joining clamp 102 and sleeve 101 would employ a swivel device at 103. This would permit sleeve 101 to swivel with respect to clamp 102 and allow the displacement of post 12 at angles other than right angles to the run of rail 11.

The effect of the choice in the manner in which sleeve 101 is affixed to clamp 102 is depicted in FIG. 6. Here it is assumed that clamp 102 is rigidly welded to sleeve 101. Although the ground contour illustrated in FIG. 6 is one which varies in elevation, the run of the fence is capable of following the ground contour because end caps 13 are joined in a manner which permits them to swivel one with respect to the other. However, because clamp 102 is rigidly affixed to sleeve 101, fence posts 12 must be positioned so as to be perpendicular to the run of their associated fence rail 11. This means that fence posts 12 will not necessarily be plumb at all locations along the fence run. However, this does not present a significant problem to the novice fence builder. Since all parts of the fence assembly are slide adjustable, the posts may be placed in their respective post holes and allowed to freely assume their respective angular dispositions as each section of fence railing is installed. It is a simple matter to then fill in the post holes to provide the necessary ground support for the fence. The problem is obviated, of course, where the enclosure is being erected for temporary purposes only and the fence posts are merely placed in contact with the ground, rather than being emplaced in the ground itself.

The situation would be further eased if sleeve 101 and clamp 102 were joined together to permit one to swivel with respect to the other. In this case, all fence posts could be preset and plumb before the fence rails were put into position. The flexibility of such a system has much to offer, but the advantages may well be offset by the cost of providing a swivel connection between clamp and sleeve.

FIG. 6 illustrates also the use of stop posts 16 at either end of the fence run. The stop post, as its name implies, prevents the removal of fence rails 11, which otherwise might be readily slid from their desired positions. In lieu of using a stop post to impede the removal of rails 11, end caps 13 may be utilized at the ends of the terminal rails and a wire fastener affixed between lug 14 of said end cap and the adjacent fence post 12 to prevent the rails from being slid from their desired positions and to protect the integrity of the fenced-in enclosure An octagon-shaped enclosure is illustrated in FIG. 7. Use of the teachings of this invention to fence in the illustrated enclosure makes the task simple and relatively easy for even those unskilled in the art. Only simple hand tools are required to erect a fence in the manner herein proposed. Because most of the elements of the fence are joined in a slide-fit fashion, the entire fence may be readily dismantled. In our mobile society of today, this latter characteristic represents a means whereby a homeowner may salvage and maintain his investment should his hobby or avocation be one which requires the use of a rail fence enclosure.

What I have described herein is the apparatus and techniques which one unskilled in the art of fence erection may employ to provide a sturdy rail fence, which fence is conformable both to the shape of the contour of the land and that of the enclosure desired.

Having explained and illustrated my invention in such a manner that not only those skilled in the art but even those who are unskilled therein may practice it, that which I claim as new and desire to secure by Letters Patent of the United States is:

1. In a fence including rails and posts, improved means for simplifying the construction and the disassembly of said fence, said means comprising:

(a) means, engaging said posts, which posts lie in one plane, and slidably receiving and supporting said rails in another plane parallel to said one plane (b) caps slidably rotatably mounted on the terminal ends of said rails, and (c) means for adjustably pivotally connecting juxtaposed portions of at least two of said caps mounted on adjacent ends of rails converging on an identical point in between said posts such that said caps may be horizontally and vertically positioned in relation to each other, and continuous rail line generally conforming to ground contour and to the desired line of travel of said fence may be formed.

* * * * *